US012692115B2

(12) United States Patent
Hege et al.

(10) Patent No.: US 12,692,115 B2
(45) Date of Patent: Jul. 28, 2026

(54) CONVEYOR HAVING OPPOSED UPPER AND LOWER DECKS AND LATERALLY SHIFTABLE LOWER DECK

(71) Applicant: A. G. Stacker Inc., Weyers Cave, VA (US)

(72) Inventors: Dalton Hege, Weyers Cave, VA (US); Joseph Wunder, Lexington, VA (US); Eric Stempihar, Rockingham, VA (US)

(73) Assignee: A. G. Stacker Inc., Weyers Cave, VA (US)

( * ) Notice: Subject to any disclaimer, the term of this patent is extended or adjusted under 35 U.S.C. 154(b) by 0 days.

(21) Appl. No.: 18/782,138

(22) Filed: Jul. 24, 2024

(65) Prior Publication Data

US 2024/0375903 A1 Nov. 14, 2024

Related U.S. Application Data

(63) Continuation of application No. 17/879,131, filed on Aug. 2, 2022, now Pat. No. 12,084,300.

(60) Provisional application No. 63/228,690, filed on Aug. 3, 2021.

(51) Int. Cl.

| | |
|---|---|
| ***B65H 29/12*** | (2006.01) |
| ***B65H 5/02*** | (2006.01) |
| ***B65H 29/20*** | (2006.01) |

(52) U.S. Cl.

CPC ..... *B65H 29/12* (2013.01); *B65H 29/20* (2013.01); *B65H 2404/152* (2013.01); *B65H 2404/1532* (2013.01); *B65H 2404/261* (2013.01); *B65H 2801/42* (2013.01)

(58) Field of Classification Search

CPC ..... B65H 29/12; B65H 29/14; B65H 29/16; B65H 29/20; B65H 2404/261; B65H 2404/152; B65H 2404/1532; B65H 2404/262; B65H 2404/2693; B65H 5/025; B65H 5/023; B65H 2701/1762; B65H 2701/176; B65H 2801/42

See application file for complete search history.

(56) References Cited

U.S. PATENT DOCUMENTS

| | | | |
|---|---|---|---|
| 3,860,232 A | 1/1975 | Martin | |
| 9,027,737 B2 | 5/2015 | Talken et al. | |
| 10,029,877 B2 * | 7/2018 | Allen, Jr. ..... | B08B 5/00 |
| 10,071,873 B2 | 9/2018 | Allen, Jr. et al. | |
| 10,351,380 B2 | 7/2019 | Allen, Jr. et al. | |

* cited by examiner

*Primary Examiner* — Luis A Gonzalez

(74) *Attorney, Agent, or Firm* — J-TEK LAW PLLC; Jeffrey D. Tekanic; Scott T. Wakeman

(57) ABSTRACT

A conveyor for transporting sheets along a path from an input end to a discharge end includes a main frame, an upper conveyor deck supported by the main frame and having a plurality of belts and a lower conveyor deck supported by the main frame and having a plurality of wheels supported by a plurality of shafts. The transport path is defined by the contact surfaces of the plurality of belts in the first contact region and the contact surfaces of the plurality of wheels in the second contact region, and the conveyor is configured such that the sheets make direct contact with the contact surfaces of the plurality of belts and make direct contact with the contact surfaces of the plurality of wheels when the sheets move along the transport path. The lower conveyor deck is shiftable laterally relative to the upper conveyor deck.

12 Claims, 10 Drawing Sheets

CONVEYOR HAVING OPPOSED UPPER AND LOWER DECKS AND LATERALLY SHIFTABLE LOWER DECK

CROSS-REFERENCE TO RELATED APPLICATIONS

The present application is a continuation of U.S. patent application Ser. No. 17/879,131, filed Aug. 2, 2022, pending, which claims the benefit of U.S. Provisional Patent Application No. 63/228,690 filed Aug. 3, 2021, the entire contents of which are hereby incorporated by reference.

BACKGROUND

A conventional stacking apparatus 10 is illustrated in FIG. 1. The stacking apparatus 10 is configured for use adjacent to a rotary die cut machine 12 which cuts blanks (not illustrated) from sheets of material, for example, corrugated paperboard. The stacking apparatus 10 includes a receiving or "layboy" section 14 that receives the blanks from the die cut machine 12 and discharges them onto a transfer conveyor 16. The transfer conveyor 16 carries the blanks to an inclined main conveyor 18, and the blanks travel along the main conveyor 18 to its downstream end 20 where they are discharged into an accumulator 22 (sometimes referred to as a "hopper").

Die cut machines produce a certain amount of scrap material during operation which consists mainly of the portions of the input material that do not become part of a finished blank. In addition, each blank may include slots or through-openings. The material cut from the blanks to form these slots and through-openings also constitutes scrap.

Most scrap material produced by the die cut machine drops beneath or immediately in front of the die cut machine as it operates. However, it is not uncommon for a sheet to be cut incompletely so that portions of the sheet that were supposed to be removed wind up traveling into the layboy with the blank. Excessive scrap in the transport path between the layboy section and the final stack of blanks may adversely affect the transport of the blanks. That is, the scrap may interfere with the alignment of the blanks or lead to jams. Alternately, if the scrap is carried all the way through the transport path and into the final stack of blanks, the blanks in the stack will have gaps therebetween where the scrap material is present thus resulting in a crooked, or oversized or non-uniform stack of blanks. Some scrap may even end up inside a finished box formed from the cut blanks; this is generally undesirable to most end customers and must be completely avoided in some applications such as boxes for use to package food.

It is therefore known to provide various scrap removal devices in a layboy. A layboy including scrap removal features is disclosed in U.S. Pat. No. 10,071,873, assigned to A.G. Stacker Inc., the contents of which are hereby incorporated by reference.

FIG. 2 shows a conventional conveyor section 50 of the '873 patent that includes an upper frame 52 having four upper vertical supports 54 supporting an upper conveyor deck 56 and a lower frame 58 having four lower vertical supports 60 supporting a lower conveyor deck 62. The upper vertical supports 54 and lower vertical supports 60 form a main frame of the conveyor section 50. At least one, and preferably all of the four lower vertical supports 60, includes a drive (not illustrated), e.g., a screw drive, a hydraulic cylinder, etc. connected to the four upper vertical supports 54 for raising and lowering the upper frame 52 relative to the lower frame 58 for adjusting a vertical dimension of a sheet transport path between contact elements of the upper conveyor deck 56 and the lower conveyor deck 62. First and second scrap removal conveyors 64 are mounted on the lower frame 58 for carrying scrap that falls from sheets being transported toward a collection point at one end of the conveyor section 50. A dust removal vacuum system 66, which may include suitable dust filters, is supported on the upper frame 52.

Contact elements are described herein on the basis of the structure that makes contact with a sheet of material being transported along a transport path and that defines one side of the transport path. Therefore, even though the belts of a conveyor having belts are supported by pulleys, which may be considered a type of wheel, a conveyor having belts is not a conveyor in which the wheels are intended to contact the sheets being transported. In that case, the pulleys are not contact elements. This is true even if a small portion of one or more of the pulleys that support the belts make contact with the sheets being transported. Conveyor decks discussed herein that have wheels for forming a contact surface for transporting sheets are not conveyors having belts.

FIG. 3 shows the conveyor section 50 from the left side with a layboy conveyor 68 mounted at the upstream end 70 of the conveyor section 50. The conveyor section 50 also includes a downstream end 72. The terms "upstream" and "downstream" as used herein refer to the intended direction of sheet travel through the conveyor section 50. The terms "left" and "right" may also be used herein to refer to portions of the conveyor section from the perspective of a person looking at the conveyor section 50 in the downstream direction, from the point of view of FIG. 2. In addition, the sheet travel direction, right to left in FIG. 3, may be referred to as a "first" direction, the vertical direction may be referred to as a "second" direction, and the direction transverse to the first and second directions, from left to right in FIG. 2, may be referred to as a "third" or lateral direction.

In FIG. 4, the upper conveyor deck 56 has been removed for illustration purposes so that the conventional lower conveyor deck 62 can more easily be seen. The lower conveyor deck 62 includes a plurality of transverse support shafts 74 that are rotatably mounted in a first support 76 at the left side of the conveyor section 50 and in a second support 78 at the right side of the conveyor section 50. End portions 80 of the support shafts 74 are operably connected to a drive 81 and interconnected by suitable drive belts or drive chains 82 so that all the support shafts 74 rotate in unison. The drive belts or drive chains 82 are located inside the second support 78 and do not contact sheets during sheet transport.

Each of the support shafts 74 includes a plurality of wheels 84. The wheels 84 are fixed against rotation relative to the support shafts 74 and therefore rotate with the support shafts 74. The wheels 84 may be discrete elements that are selectably securable to the support shafts 74, using screws or clamps (not illustrated) so that the number and location of the wheels 84 on the shafts 74 can be individually adjusted. Alternately, the wheels 64 may be formed integrally with the shafts 74 and thus comprise portions of the shafts 74 that have greater diameters. In other words, each shaft 74 may comprise first portions having a small diameter and second portions having a large diameter, the large diameter portions forming the wheels 84.

The wheels 84 on each of the shafts 74 are evenly spaced in a transverse (third) direction, that is, a direction transverse to the sheet travel direction. However, counting the shafts from front to back in the view of FIG. 4 with the front-most shaft 74 being the first shaft 74, the wheels 84 on the odd numbered shafts are offset in the third direction from the wheels 84 on the even-numbered shafts. The wheels on all the odd-numbered shafts 74 are mutually aligned in the sheet travel (first) direction, and the wheels on the even-numbered shafts are mutually aligned in the sheet travel (first) direction. However, when viewed from the left side of the conveyor section 50, from the perspective of FIG. 3, for example, the wheels 84 of the even number shafts 74 overlap the wheels 84 of the odd numbered shafts 74 in the first direction. In other words, the diameter of each of the wheels 84 is greater than half the distance between each pair of shafts 74 in the sheet travel (first) direction. Staggering the wheels 84 in this manner helps provide a suitable support surface for sheets being transported. The shafts 74 are mounted such that the tops of the wheels 84 lie substantially in a single plane and such that a sheet resting on the wheels 84 will be substantially horizontal and planar.

The wheels 84 are intended to make contact with sheets being transported, and the wheels 84 may therefore sometimes be referred to as "contact elements." The radially outer surfaces of the wheels 84 may be referred to as "contact surfaces" because they are intended to directly contact sheets being transported through the conveyor section 50. These outer surfaces may be knurled to increase friction between the wheels 84 and the sheets. The portions of the wheels 84 facing in the direction of the upper conveyor deck 56, which portions will directly contact sheets, are described as being located in "contact regions." These contract regions of the wheels 84 are the regions of essentially line-contact between the sheets and the wheels 84 (because the sheets are not perfectly rigid, the area of contact is likely to be a small angular portion of the wheels 84 rather than a line). The contact regions therefore lie in a plane or are bounded by a plane, the plane representing the plane of a hypothetical perfectly rigid sheet resting on the surfaces of the wheels 84. Therefore, as the wheels 84 rotate, a given point on the surface of each wheel 84 will rotate into and out of the contact region.

Referring now to FIG. 5, the upper conveyor deck 56 includes a front transverse shaft 86, a middle transverse shaft 88 and a rear transverse shaft 90 which transverse shafts 86, 88, 90 extend from left to right or in the third direction from a first support 92 at the left side of the upper conveyor deck 56 to a second support 94 at the right side of the upper conveyor deck 56. The middle transverse shaft 88 is operably connected to a drive 96.

A plurality of pulleys 98 are mounted on the middle transverse shaft 88 and attached to the middle shaft 88 so that they rotate with the shaft when the shaft 88 is driven. The pulleys 98 are evenly spaced along the middle shaft 88 and may be described as being located at first, second, third, fourth, etc. positions along the middle shaft 88. The front shaft 86 also includes a plurality of pulleys 98 that are fixed to the front shaft 86 for rotation therewith. The number of pulleys 98 on the front shaft 86 is approximately one half the number of the pulleys 98 on the middle shaft 88, and the pulleys 98 on the front shaft 86 are aligned with every other one of the pulleys 98 on the middle shaft 88. In FIG. 5, the pulleys 98 on the front shaft 86 are aligned with the even-numbered pulleys 98 on the middle shaft 88.

The rear shaft 90 also includes a plurality of the pulleys 98 fixed to the rear shaft 90 for rotation therewith. The pulleys 98 on the rear shaft 90 are aligned with the odd-numbered pulleys 98 of the middle shaft 88. Belts 100 connect aligned pairs of pulleys 98 on the front shaft 86 and the middle shaft 88 and aligned pairs of the pulleys 98 on the middle shaft 88 and the rear shaft 90. Because the middle shaft 88 is driven by the drive 96 and the middle shaft 88 is connected to the front shaft 86 and to the rear shaft 90 by the belts 100, the front shaft 86 and the rear shaft 90 are driven by the rotation of the middle shaft 88.

The belts 100 of the upper conveyor deck 56 are examples of sheet contact elements that are configured to make direct contact with sheets traversing the conveyor section 50. The portions of the belts 100 that face the lower conveyor deck 62 form sheet contact surfaces. These sheet contact surfaces lie substantially in a plane parallel to the sheet transport direction. The portions of the belts 100 that face the lower conveyor deck 62 are located in a contact region, and all points on the belts 100 travel from contact regions (facing the lower conveyor deck 62) to non-contact regions (facing away from the lower conveyor deck 62) as the belts 100 rotate.

The conveyor section 50 functions adequately for its intended purpose. However, it would be desirable to further reduce the presence of scrap in a stream of sheets being conveyed in a sheet stacking system while maintaining or improving control over the movement of the sheets.

SUMMARY

This problem is addressed by embodiments of the present disclosure, a first aspect of which comprises a conveyor configured to transport sheets along a transport path in a first direction from an input end to a discharge end. The conveyor includes a main frame, an upper conveyor deck supported by the main frame and a lower conveyor deck supported by the main frame. The upper conveyor deck includes a plurality of belts each having a contact surface movable around a first closed path from a first contact region to a first non-contact region, the first contact regions lying in a first plane or being bounded by the first plane. The lower conveyor deck is spaced from the upper conveyor deck in a second direction perpendicular to the first direction and includes a first side frame spaced from a second side frame in a third direction perpendicular to the first and second directions and a plurality of shafts extending between the first side frame and the second side frame. The plurality of shafts are spaced apart in the first direction, and each shaft of the plurality of shafts supports a plurality of wheels. Each wheel of the plurality of wheels has a contact surface movable around a second closed path from a second contact region to a second non-contact region, the second contact regions lying in a second plane or being bounded by the second plane. The first plane is coextensive with the second plane or is spaced from the second plane in the second direction, the transport path of the conveyor is defined by the contact surfaces of the plurality of belts in the first contact region and the contact surfaces of the plurality of wheels in the second contact region, the conveyor is configured such that the sheets make direct contact with the contact surfaces of the plurality of belts and make direct contact with the contact surfaces of the plurality of wheels when the sheets move along the transport path, and the lower conveyor deck is supported by the main frame for movement in the second direction relative to the upper conveyor deck.

BRIEF DESCRIPTION OF THE DRAWINGS

These and other features and aspects of the present disclosure will be better understood after a reading of the following detailed description in connection with the attached drawings in which.

DETAILED DESCRIPTION

Figure 1:
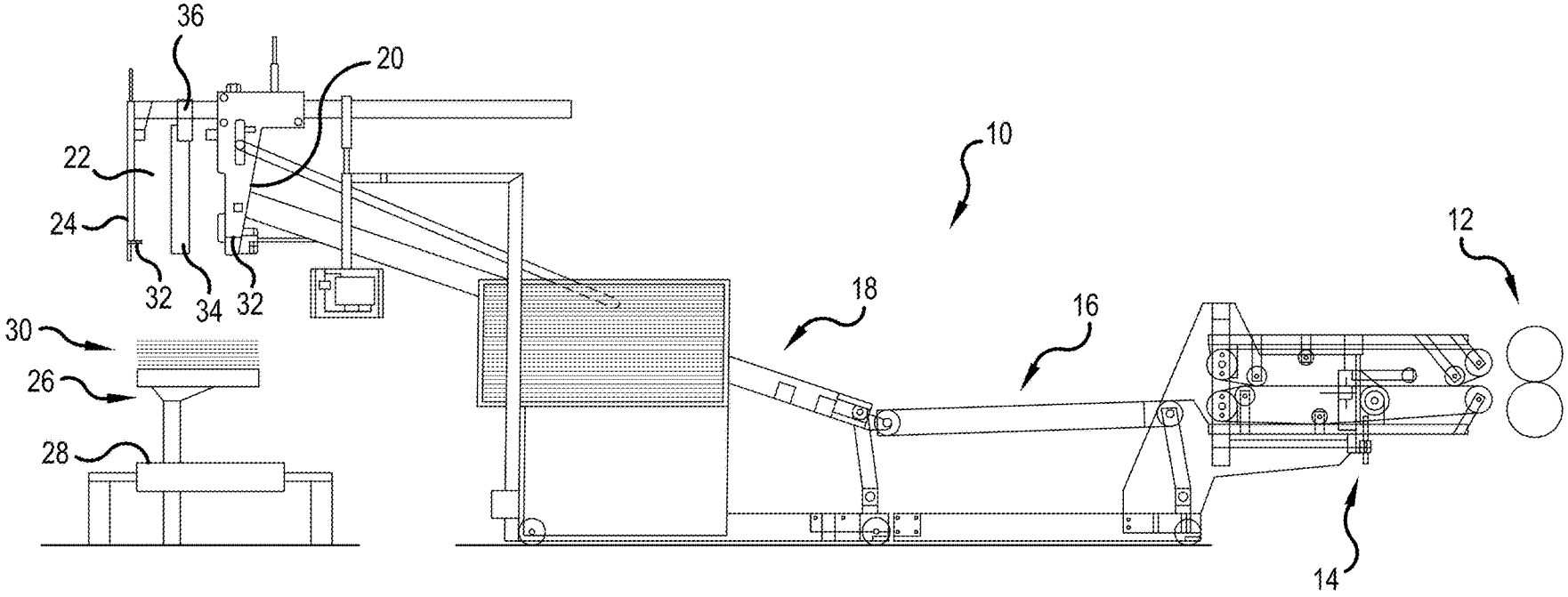
FIG.1 CONVENTIONAL ART
FIG. 1 is a side elevational view of a conventional stacking system that includes a layboy, a transfer conveyor and a main conveyor.
Figure 2:
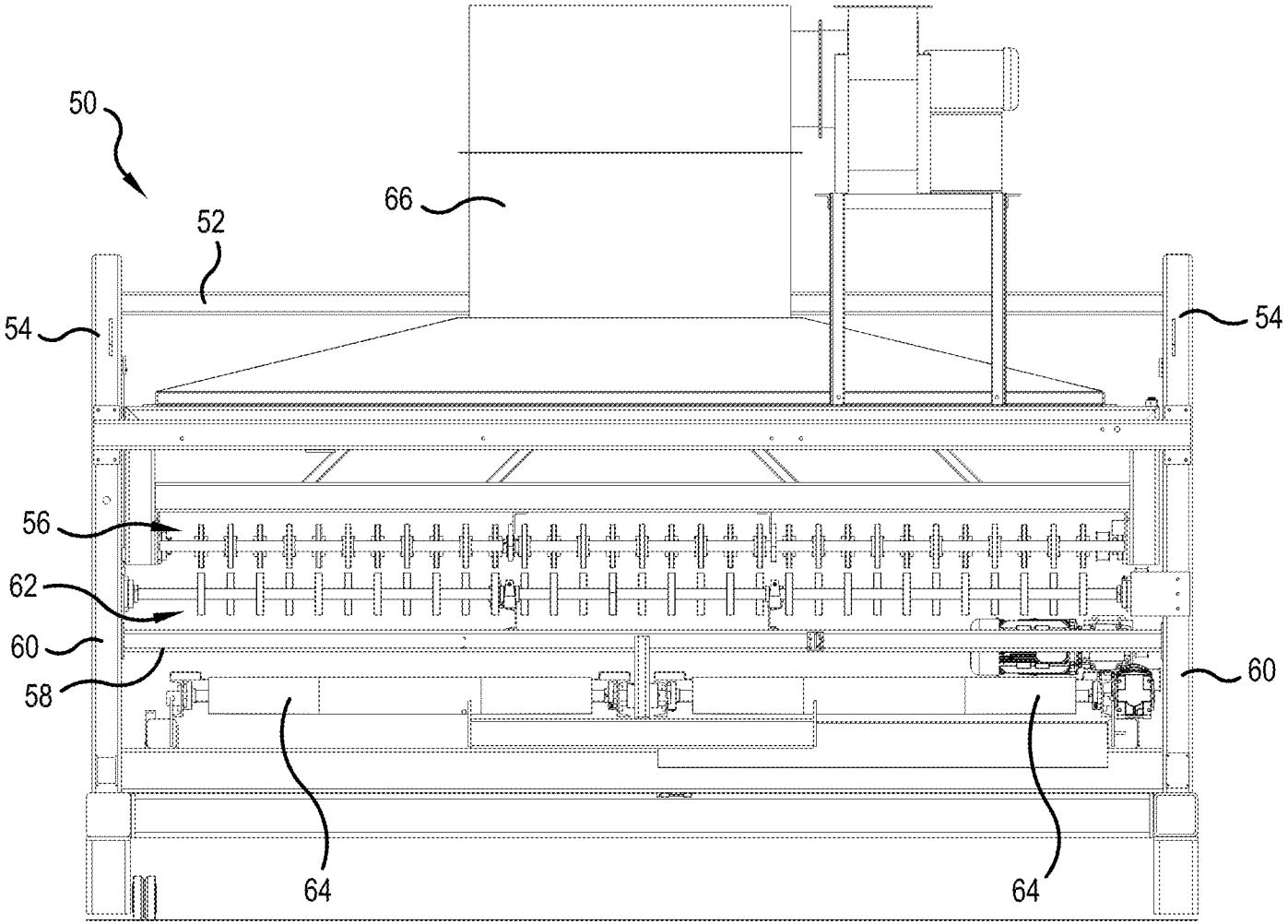
FIG.2 CONVENTIONAL ART
FIG. 2 is front elevational view of a conventional conveyor section having upper and lower conveyor decks.
Figure 3:
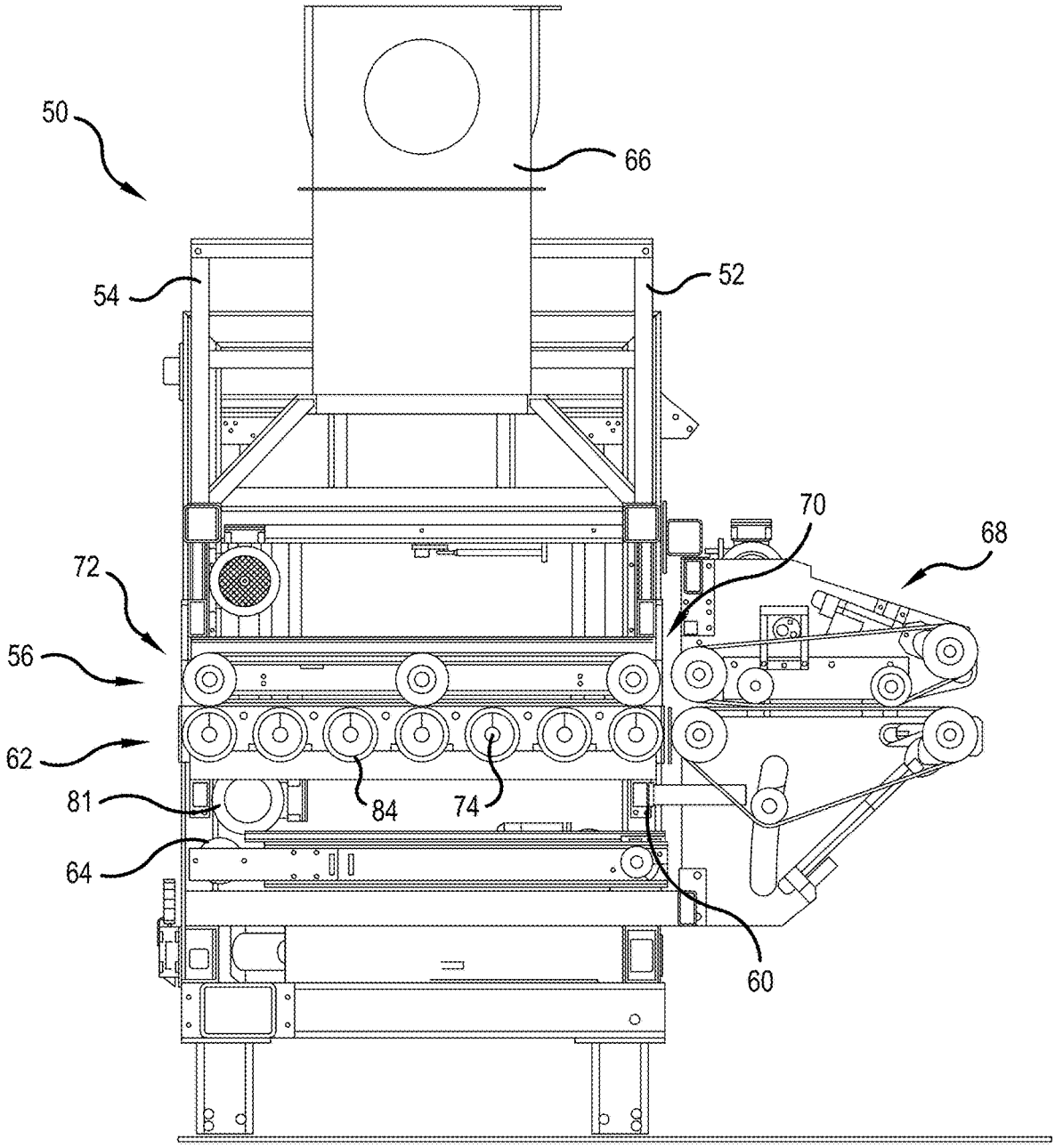
FIG.3 CONVENTIONAL ART
FIG. 3 is a left side elevational view of the conveyor section of FIG. 2.
Figure 4:
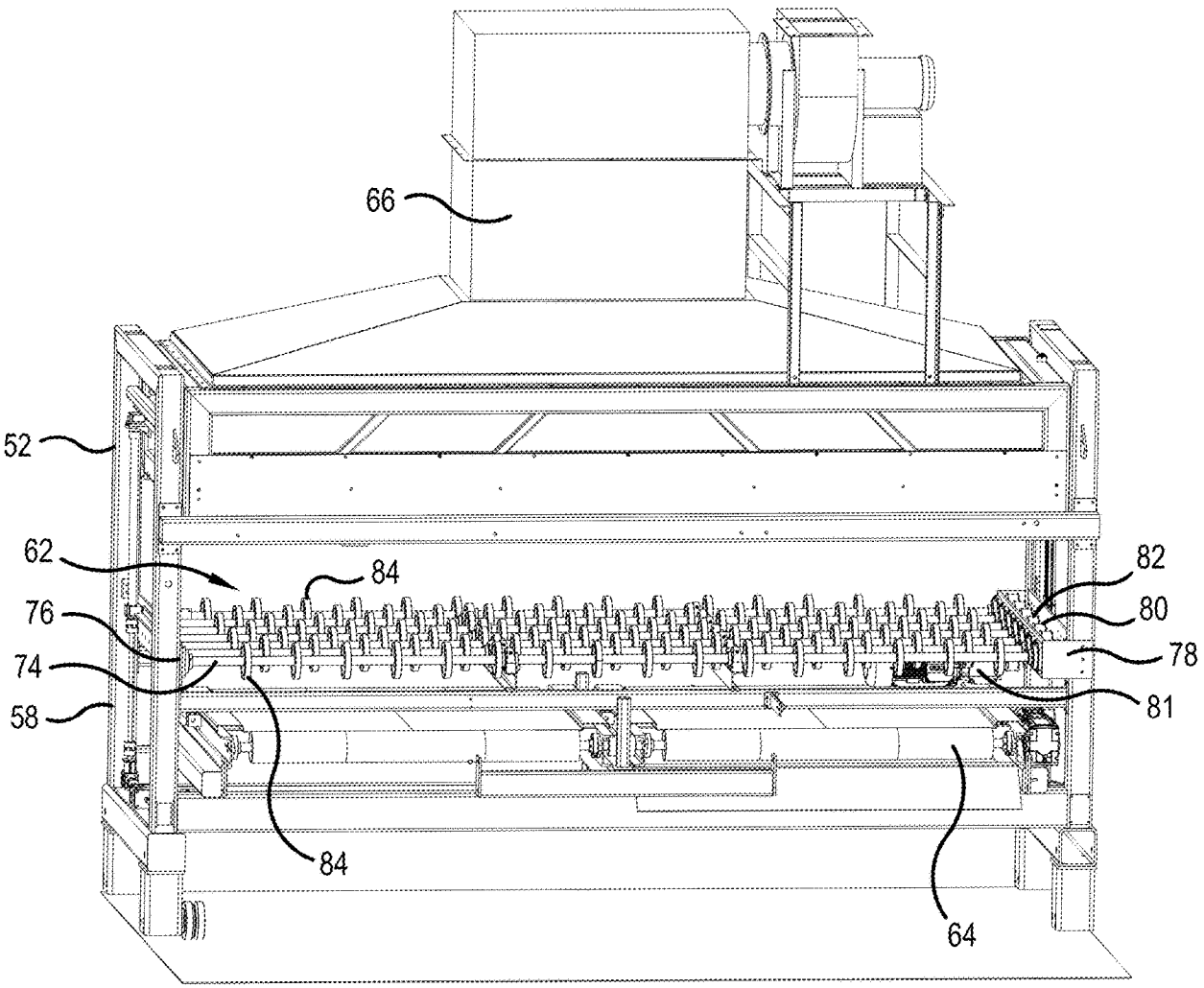
FIG.4 CONVENTIONAL ART
FIG. 4 is perspective view of the conveyor section of FIG. 2 with the upper deck removed for illustration purposes and looking down at the top of the lower conveyor deck.
Figure 5:
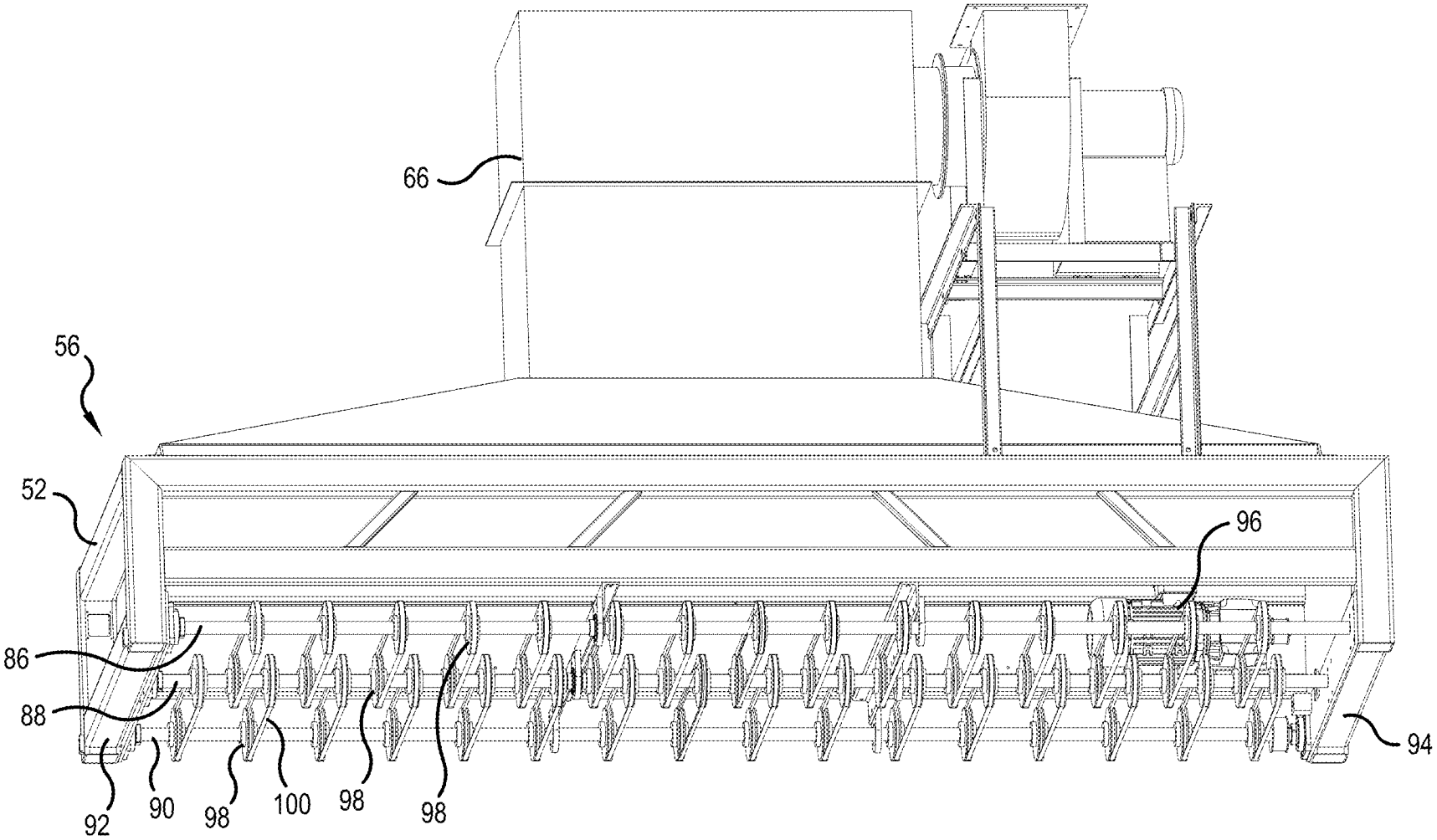
FIG.5 CONVENTIONAL ART
FIG. 5 is a perspective view of the upper conveyor deck of FIG. 2 separated from the conveyor section for illustration purposes.

Referring now to the drawings, wherein the showings are for the purpose of illustrating embodiments of the disclosure only and not for the purpose of limiting same, FIGS. 6-11 show a conveyor section 50' that includes a lower conveyor deck 200. The conveyor section 50' is substantially the same as the conveyor section 50 but the lower conveyor deck 62 replaced by a lower conveyor deck 200 along with further minor modifications discussed below.

The lower conveyor deck 200 is modular and includes first and second parallel side frame members 202 connected by front and rear frame members 204 which side frame members 202 and front and rear members 204 may be referred to as a "sub-frame," which, along with the upper conveyor deck 56 is supported by the main frame formed by, inter alia, the upper vertical supports 54 and the lower vertical supports 60. A plurality of wheel shafts 206 extend between the side frame member 202, and each of the wheel shafts 206 supports a plurality of individual wheels 208. Some or all of the wheel shafts 206 may be connected to and driven by a drive, such as the drive 210 in FIGS. 7 and 9.

Figure 11:
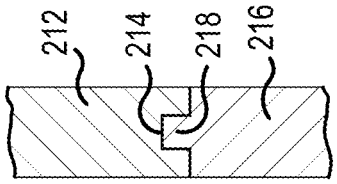
FIG. 11 is a sectional view taken along line XI-XI in FIG. 7.
Figure 6:
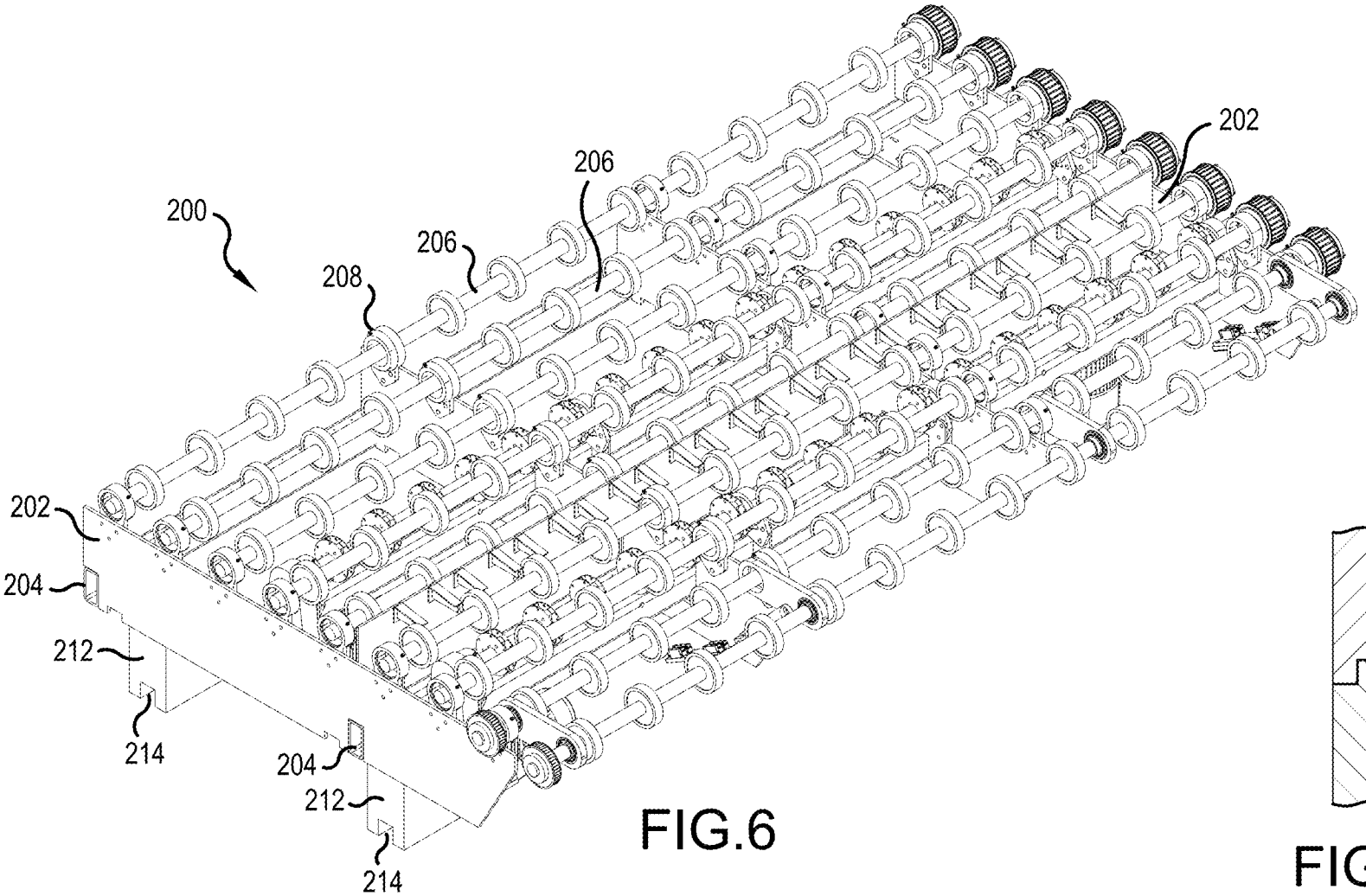
FIG. 6 is a perspective view of a lower conveyor deck for a conveyor section according to an embodiment of the present disclosure.

The side frame members 202 are mounted on front and rear support guides 212 which extend transversely across the lower conveyor deck 200. Each of the support guides 212 includes a channel 214 that extends along the length of the bottom side thereof parallel to the length direction of the wheel shafts 206. The conveyor deck 200 also includes front and rear support rails 216—only the front support rail 216 is visible in FIGS. 7 and 9. The front and rear support rails 216 each include a ridge 218 on an upper surface thereof (FIG. 11). The support guides 212 are mounted on the support rails 216 such that the ridges 218 are received in the channels 214 which allows the entire lower conveyor deck 200 to slide along the support rails 216 to change the lateral spacing (spacing in the third direction) between the belts 100 of the upper conveyor deck 56 and the wheels 208 of the lower conveyor deck 200.

Figure 7:
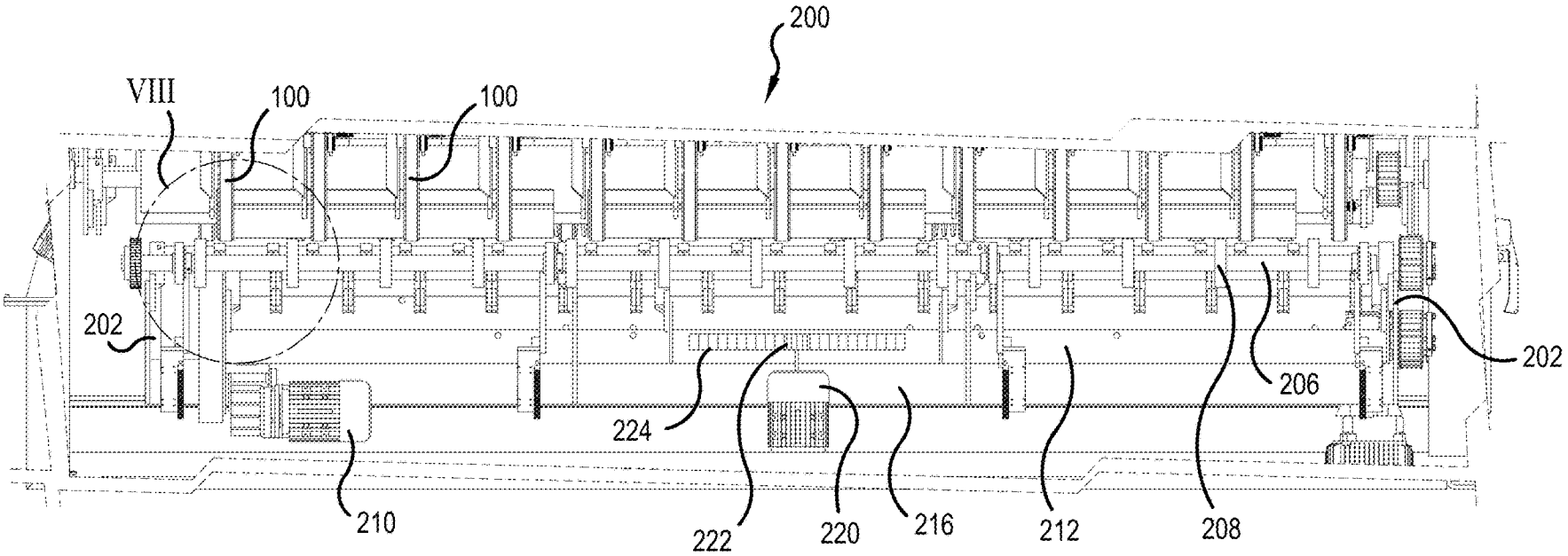
FIG. 7 is a front end elevational view of a conveyor section including the lower conveyor deck of FIG. 6 located in a first lateral position relative to the upper deck.
Figure 8:
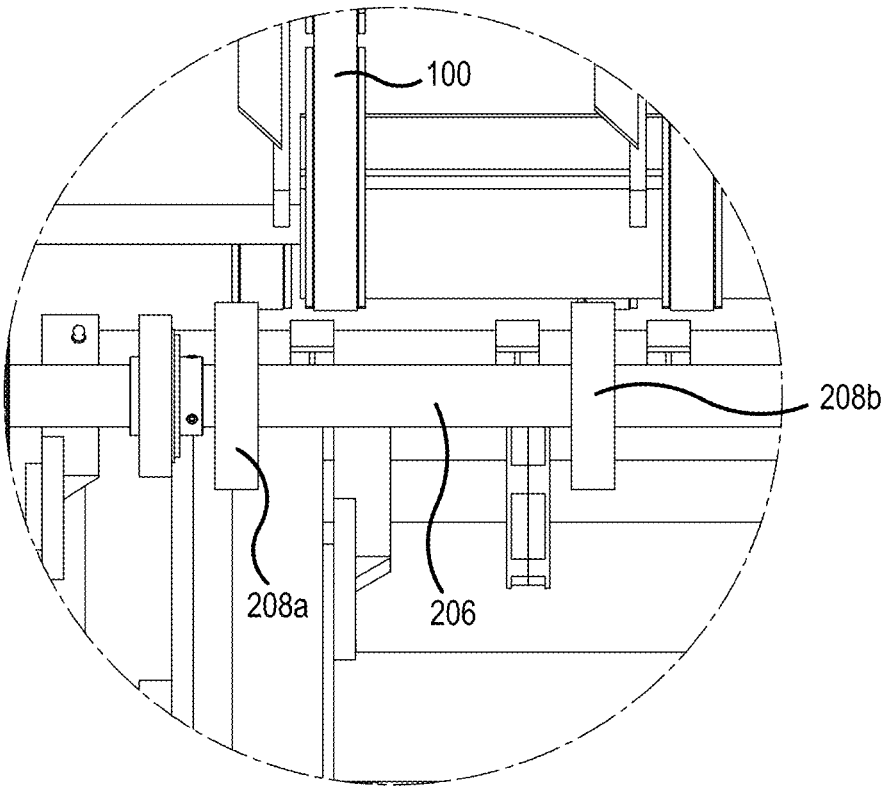
FIG. 8 is a detail view of region VIII in FIG. 7.
Figure 9:
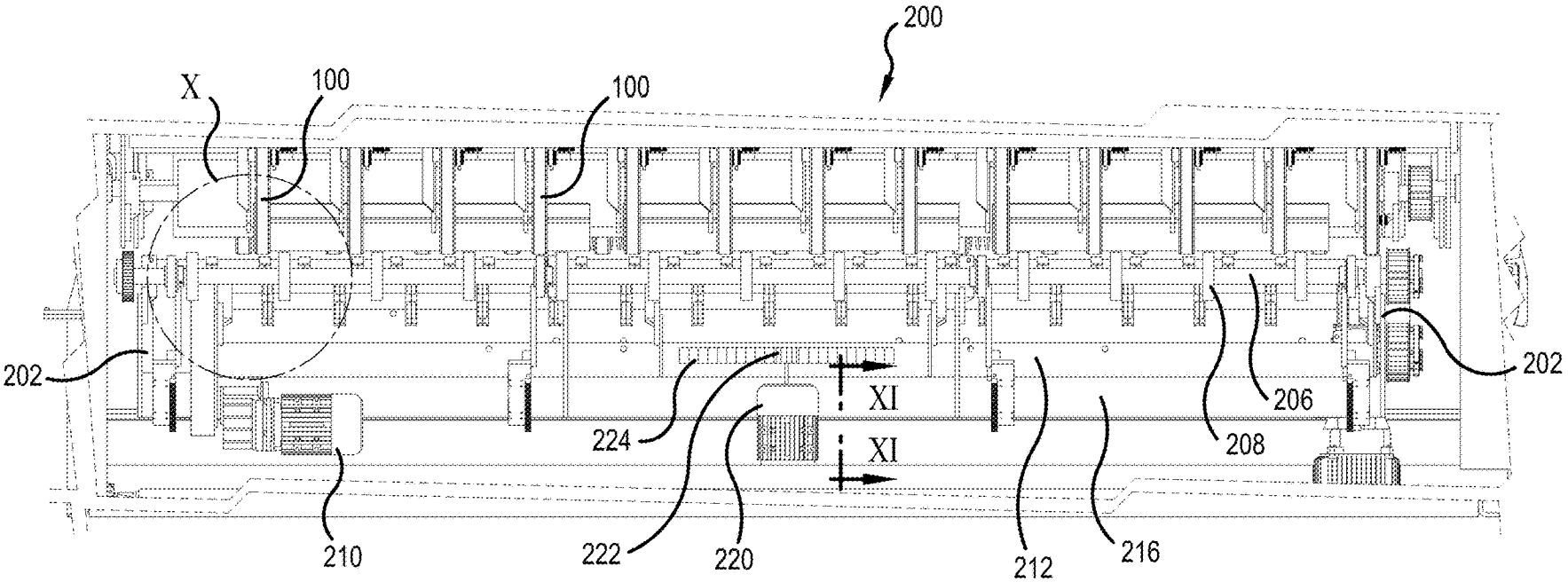
FIG. 9 is a front end elevational view of conveyor section of FIG. 7 showing the lower conveyor deck in a second lateral position relative to the upper deck.
Figure 10:
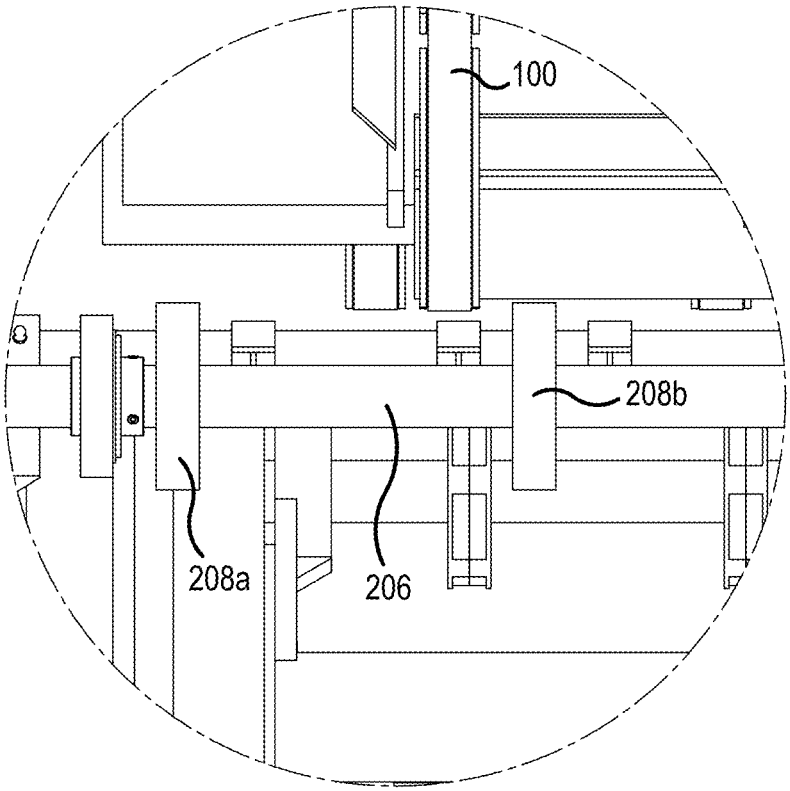
FIG. 10 is a detail view of region X in FIG. 9.

FIG. 7 shows the lower conveyor deck 200 moved to its rightmost position. The detail view of FIG. 8 shows two wheels 208*a* and 208*b* of the wheels 208 of the lower wheel deck 200 and one of the belts 100 of the upper conveyor deck 56 located above a gap between the wheels 208*a*, 208*b*. FIG. 8 shows that when the lower conveyor deck 200 is in its rightmost position, the belt 56 is located closer to the left side wheel 208*a* than to the right side wheel 208*b*. FIG. 9 shows the lower conveyor deck 200 in its leftmost position. In this position, the same belt 100 is located closer to the right side wheel 208*b*. Thus, in this embodiment, the wheels 208 of the lower conveyor deck 200 can be moved approximately four inches laterally relative to the belts 100 of the upper conveyor deck 56.

The channels 214 and/or the rails 216 can be lubricated and/or provided with a low-friction coating to facilitate sliding movement of the lower conveyor deck 200 along the rails 216. As an alternative, roller bearings (not illustrated) could be provided between the support guides 212 and the support rails 216. Even when supported by roller bearings, the movement of the lower conveyor deck 200 will still be described as a "sliding" movement.

The transverse position of the lower conveyor deck 200 can be set manually, in which case a suitable clamp (not illustrated) will be provided to secure the lower conveyor deck 200 to the support rails 216 in a given position along the support rails 216. The lower conveyor deck 200 can also be moved by a drive 220 mounted on one of the support rails 216 turning a pinion 222 engaged with a rack 224 on the support guide 212 so that the rotation of the drive 220 in first and second directions moves the lower conveyor deck 200 in first and second directions relative to the support rails 216 and relative to the main frame of the conveyor section. As an alternative, the drive 220 could rotate a friction wheel (not illustrated) that contacts the support guide 212. The drive could also be mounted on the support guide 212 and the rack 224 could be mounted on the support rail 216. As a further alternative, a hydraulic or pneumatic actuator (not illustrated) could be used to slide the lower conveyor deck 200 along the support rails 216.

The ability to adjust the spacing in the third direction between the belts 100 of the upper conveyor deck 56 and the wheels 208 of the lower conveyor deck 200 allows optimal support to be provided for sheets of material having different shapes. In particular, some boards or sheets being transported may include flaps that project perpendicularly to the sheet transport projection. It is often desirable to ensure that these flaps are supported by a wheel 208 of the lower wheel deck 200, and this is facilitated by the adjustable wheel deck 200 discussed above which can be positioned based on the shapes and/or sizes of the sheets or boards to be transported. In addition, by positioning the wheels 208 of the lower conveyor deck 200 where scrap is less likely to be located, that is, away from longitudinal notches or gaps in the blanks, any scrap that is present will have a better chance of being dislodged as it moves through the conveyor section.

In operation, the upper conveyor deck 56 is positioned relative to the lower conveyor deck 200 so that the vertical separation between the plane in which the tops of the wheels 208 lie and the plane in which the bottoms of the belts 100 lie are separated by a desired distance based on the thickness of the sheets to be transported. In order to allow adequate control of the movement of the sheets without crushing or damaging the sheets during transport, the vertical separation will be approximately equal to the thickness of the sheets being transported. The sheets will exit the layboy conveyor 68 and enter a nip at the upstream end 70 of the conveyor section 50', which nip is defined by the belts 100 of the upper conveyor section 56 and the wheels 208 of the lower conveyor section 200. The lower conveyor deck drive 210 and the upper conveyor deck drive 96 are coordinated so that the belts 100 travel at the same speed as the tops of the wheels 208, and this pulls the sheets along the conveyor section 50' from the upstream end 70 to the downstream end 72 and ejects the sheets to a downstream conveyor (not illustrated) which may comprise the main conveyor 18 of a stacking system as illustrated in FIG. 1.

In many cases, belts 100 provide a greater degree of control over the movement of sheets in a conveyor because a relatively large surface area of the belts remains in contact with the sheets as they move along a conveyor section. At the same time, this greater area of contact may hold scrap against the sheets and prevent the scrap from being removed from the sheets before they are stacked. It has been found that using wheels 208 on the lower conveyor deck 200 makes it easier for scrap to fall from the sheets and out of the sheet transport path (onto the scrap removal conveyors 64, for example) than if belts were used on both the upper and lower conveyor decks 56, 200. That is, all lower surfaces of the sheets are free from roller or wheel contact at some time as the sheets traverse the conveyor section 50'. At the same time, the use of belts 100 on the upper conveyor deck 56 provides adequate control over the movement of the sheets. And, because the belts 100 are staggered such that no individual belt 100 extends all the way from the upstream end 70 to the downstream end 72 of the conveyor section 50', all upper surfaces of the sheets are free from belt contact at some point as they traverse the conveyor section 50'. This arrangement, when used with brushes, blowers, vacuums or other devices for removing scrap from sheets, has been found to improve the scrap removal process.

The present invention has been described herein in terms of a preferred embodiment. Additions and modifications to this embodiment will become apparent to persons of ordinary skill in the art upon a reading of the foregoing description. It is intended that all such modifications and additions form a part of the present invention to the extent they fall within the scope of the several claims appended hereto.

What is claimed is:

1. A conveyor configured to transport sheets along a transport path in a first direction from an input end to a discharge end, the conveyor comprising:

a main frame;

an upper conveyor deck supported by the main frame and comprising a plurality of belts each having a contact surface movable around a first closed path from a first contact region to a first non-contact region, the first contact regions lying in a first plane or being bounded by the first plane;

a lower conveyor deck supported by the main frame and spaced from the upper conveyor deck in a second direction perpendicular to the first direction, the lower conveyor deck comprising a first side frame spaced from a second side frame in a third direction perpendicular to the first and second directions and a plurality of shafts extending between the first side frame and the second side frame, the plurality of shafts being spaced apart in the first direction, each shaft of the plurality of shafts supporting a plurality of wheels, each wheel of the plurality of wheels having a contact surface movable around a second closed path from a second contact region to a second non-contact region, the second contact regions lying in a second plane or being bounded by the second plane, wherein the first plane is coextensive with the second plane or is spaced from the second plane in the second direction, wherein the transport path of the conveyor is defined by the contact surfaces of the plurality of belts in the first contact region and the contact surfaces of the plurality of wheels in the second contact region, wherein the conveyor is configured such that the sheets make direct contact with the contact surfaces of the plurality of belts and make direct contact with the contact surfaces of the plurality of wheels when the sheets move along the transport path, and wherein the lower conveyor deck is supported by the main frame for movement in the third direction relative to the upper conveyor deck.

2. The conveyor according to claim 1, including a drive operably connected to the plurality of shafts, the drive being configured to rotate the plurality of shafts.

3. The conveyor according to claim 2, wherein the drive is mounted to and supported by the lower conveyor deck.

4. The conveyor according to claim 3, wherein a spacing in the second direction between the first plane and the second plane is adjustable.

5. The conveyor according to claim 4, wherein the lower conveyor deck is supported by the main frame for sliding movement in the third direction.

6. The conveyor according to claim 4, including means for moving the lower conveyor deck in the third direction.

7. A system comprising:

a rotary die cut machine;

the conveyor according to claim 4 positioned with the input end facing an output of the rotary die cut machine to receive blanks output by the rotary die cut machine; and a secondary conveyor having an input end at the output end of the conveyor and configured to receive the blanks output by the conveyor.

8. The conveyor according to claim 1, wherein the lower conveyor deck is shiftable in the third direction from a first position in which one of the plurality of wheels is located a first distance from one of the plurality of belts in the third direction to a second position in which the one of the plurality of wheels is located a second distance from the one of the plurality of belts in the third direction, the second distance being greater than the first distance.

9. The conveyor according to claim 1, wherein a spacing in the second direction between the first plane and the second plane is adjustable.

10. The conveyor according to claim 1, wherein the lower conveyor deck is supported by the main frame for sliding movement in the third direction.

11. The conveyor according to claim 1, including means for moving the lower conveyor deck in the third direction.

12. A system comprising:

a rotary die cut machine;

the conveyor according to claim 1 positioned with the input end facing an output of the rotary die cut machine to receive blanks output by the rotary die cut machine; and a secondary conveyor having an input end at the output end of the conveyor and configured to receive the blanks output by the conveyor.

* * * * *